US008573331B2

(12) United States Patent
Hall et al.

(10) Patent No.: US 8,573,331 B2
(45) Date of Patent: Nov. 5, 2013

(54) ROOF MINING DRILL BIT

(76) Inventors: David R. Hall, Provo, UT (US); Ronald Crockett, Payson, UT (US)

( * ) Notice: Subject to any disclaimer, the term of this patent is extended or adjusted under 35 U.S.C. 154(b) by 493 days.

(21) Appl. No.: 12/915,250

(22) Filed: Oct. 29, 2010

(65) Prior Publication Data

US 2011/0042150 A1 Feb. 24, 2011

Related U.S. Application Data

(63) Continuation of application No. 11/774,667, filed on Jul. 9, 2007, now abandoned, which is a continuation-in-part of application No. 11/766,975, filed on Jun. 22, 2007, now Pat. No. 8,122,980, and a continuation-in-part of application No. 11/774,227, filed on Jul. 6, 2007, now Pat. No. 7,669,938, which is a continuation-in-part of application No. 11/773,271, filed on Jul. 3, 2007, now Pat. No. 7,997,661, which is a continuation-in-part of application No. 11/766,903, filed on Jun. 22, 2007, which is a continuation of application No. 11/766,865, filed on Jun. 22, 2007, now abandoned, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, which is a continuation-in-part of application No. 11/463,953, filed on Aug. 11, 2006, now Pat. No. 7,464,993, said application No. 11/774,667 is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770.

(51) Int. Cl.
*E21B 10/62* (2006.01)

(52) U.S. Cl.
USPC ..... 175/427; 175/385

(58) Field of Classification Search
USPC ..... 175/406, 385, 427
See application file for complete search history.

(56) References Cited

U.S. PATENT DOCUMENTS 616,118 A 12/1889 Kunhe
465,103 A 12/1891 Wegner
946,060 A 1/1910 Looker (Continued)

*Primary Examiner* — John Kreck
(74) *Attorney, Agent, or Firm* — Philip W. Townsend, III

(57) ABSTRACT

In one aspect of the invention a rotary mine roof drilling apparatus has an arm attached to and intermediate a drill bit and a platform. The apparatus also has a thrusting mechanism adapted to push the drill bit into a mine roof. The drill bit has a bit body intermediate a shank and a working surface. The working surface has a cutting element with a carbide substrate bonded to a diamond working end with a pointed geometry; and the diamond working end has a 0.050-0.200 inch apex radius.

12 Claims, 8 Drawing Sheets

(56) References Cited

U.S. PATENT DOCUMENTS

| | | | | |
|---|---|---|---|---|
| 1,116,154 | A | 11/1914 | Stovvers | |
| 1,183,630 | A | 5/1916 | Bryson | |
| 1,189,560 | A | 7/1916 | Gondos | |
| 1,360,908 | A | 11/1920 | Everson | |
| 1,387,733 | A | 8/1921 | Midgett | |
| 1,460,671 | A | 7/1923 | Hebsacker | |
| 1,544,757 | A | 7/1925 | Hufford | |
| 2,169,223 | A | 8/1931 | Christian | |
| 1,821,474 | A | 9/1931 | Mercer | |
| 1,879,177 | A | 9/1932 | Gault | |
| 2,054,255 | A | 9/1936 | Howard | |
| 2,064,255 | A | 12/1936 | Garfield | |
| 2,218,130 | A | 10/1940 | Court | |
| 2,320,136 | A | 5/1943 | Kammerer | |
| 2,466,991 | A | 4/1949 | Kammerer | |
| 2,540,464 | A | 2/1951 | Stokes | |
| 2,544,036 | A | 3/1951 | Kammerer | |
| 2,755,071 | A | 7/1956 | Kammerer | |
| 2,776,819 | A | 1/1957 | Brown | |
| 2,819,043 | A | 1/1958 | Henderson | |
| 2,838,284 | A | 6/1958 | Austin | |
| 2,894,722 | A | 7/1959 | Buttolph | |
| 2,901,223 | A | 8/1959 | Scott | |
| 2,963,102 | A | 12/1960 | Smith | |
| 3,135,341 | A | 6/1964 | Ritter | |
| 3,294,186 | A | 12/1966 | Buell | |
| 3,301,339 | A | 1/1967 | Pennebaker, Jr. | |
| 3,379,264 | A | 4/1968 | Cox | |
| 3,429,390 | A | 2/1969 | Bennett | |
| 3,493,165 | A | 2/1970 | Schonfield | |
| 3,583,504 | A | 6/1971 | Aalund | |
| 3,764,493 | A | 10/1973 | Rosar | |
| 3,821,993 | A | 7/1974 | Kniff | |
| 3,955,635 | A | 5/1976 | Skidmore | |
| 3,960,223 | A | 6/1976 | Kleine | |
| 4,081,042 | A | 3/1978 | Johnson | |
| 4,096,917 | A | 6/1978 | Harris | |
| 4,106,577 | A | 8/1978 | Summer | |
| 4,109,737 | A | 8/1978 | Bovenkerk | |
| 4,176,723 | A | 12/1979 | Arceneaux | |
| 4,253,533 | A | 3/1981 | Baker | |
| 4,280,573 | A | 7/1981 | Sudnishnikov | |
| 4,304,312 | A | 12/1981 | Larsson | |
| 4,307,786 | A | 12/1981 | Evans | |
| 4,397,361 | A | 8/1983 | Langford | |
| 4,416,339 | A | 11/1983 | Baker | |
| 4,445,580 | A | 5/1984 | Sahley | |
| 4,448,269 | A | 5/1984 | Ishikawa | |
| 4,499,795 | A | 2/1985 | Radtke | |
| 4,531,592 | A | 7/1985 | Hayatdavoudi | |
| 4,535,853 | A | 8/1985 | Ippolito | |
| 4,538,691 | A | 9/1985 | Dennis | |
| 4,566,545 | A | 1/1986 | Story | |
| 4,574,895 | A | 3/1986 | Dolezal | |
| 4,640,374 | A | 2/1987 | Dennis | |
| 4,813,501 | A * | 3/1989 | Mills et al. | 175/335 |
| 4,852,672 | A | 8/1989 | Behrens | |
| 4,889,017 | A | 12/1989 | Fuller | |
| 4,962,822 | A | 10/1990 | Pascale | |
| 4,981,184 | A | 1/1991 | Knowlton | |
| 5,009,273 | A | 4/1991 | Grabinski | |
| 5,027,914 | A | 7/1991 | Wilson | |
| 5,038,873 | A | 8/1991 | Jurgens | |
| 5,119,892 | A | 6/1992 | Clegg | |
| 5,141,063 | A | 8/1992 | Quesanbury | |
| 5,186,268 | A | 2/1993 | Clegg | |
| 5,222,566 | A | 6/1993 | Taylor | |
| 5,255,749 | A | 10/1993 | Bumpurs | |
| 5,265,682 | A | 11/1993 | Russell | |
| 5,361,859 | A | 11/1994 | Tibbitts | |
| 5,410,303 | A | 4/1995 | Comeau | |
| 5,417,292 | A | 5/1995 | Polakoff | |
| 5,423,389 | A | 6/1995 | Warren | |
| 5,507,357 | A | 4/1996 | Huilt | |
| 5,535,839 | A * | 7/1996 | Brady | 175/427 |
| 5,560,440 | A | 10/1996 | Tibbitts | |
| 5,568,838 | A | 10/1996 | Struthers | |
| 5,655,614 | A | 8/1997 | Azar | |
| 5,678,644 | A | 10/1997 | Fielder | |
| 5,732,784 | A | 3/1998 | Nelson | |
| 5,794,728 | A | 8/1998 | Palmberg | |
| 5,848,657 | A | 12/1998 | Flood | |
| 5,896,938 | A | 4/1999 | Moeny | |
| 5,947,215 | A | 9/1999 | Lundell | |
| 5,950,743 | A | 9/1999 | Cox | |
| 5,957,223 | A | 9/1999 | Doster | |
| 5,957,225 | A | 9/1999 | Sinor | |
| 5,967,247 | A | 10/1999 | Pessier | |
| 5,979,571 | A | 11/1999 | Scott et al. | |
| 5,992,547 | A | 11/1999 | Caraway | |
| 5,992,548 | A | 11/1999 | Silva | |
| 6,021,859 | A | 2/2000 | Tibbitts | |
| 6,039,131 | A | 3/2000 | Beaton | |
| 6,092,612 | A * | 7/2000 | Brady | 175/325.2 |
| 6,131,675 | A | 10/2000 | Anderson | |
| 6,145,606 | A | 11/2000 | Haga | |
| 6,150,822 | A | 11/2000 | Hong | |
| 6,186,251 | B1 | 2/2001 | Butcher | |
| 6,202,761 | B1 | 3/2001 | Forney | |
| 6,213,226 | B1 | 4/2001 | Eppink | |
| 6,223,824 | B1 | 5/2001 | Moyes | |
| 6,269,893 | B1 | 8/2001 | Beaton | |
| 6,296,069 | B1 | 10/2001 | Lamine et al. | |
| 6,332,503 | B1 | 12/2001 | Pessier | |
| 6,340,064 | B2 | 1/2002 | Fielder | |
| 6,364,034 | B1 | 4/2002 | Schoeffler | |
| 6,394,200 | B1 | 5/2002 | Watson | |
| 6,408,959 | B2 | 6/2002 | Bertagnolli | |
| 6,427,782 | B2 | 8/2002 | Brady | |
| 6,439,326 | B1 | 8/2002 | Huang et al. | |
| 6,474,425 | B1 | 11/2002 | Truax | |
| 6,484,825 | B2 | 11/2002 | Watson | |
| 6,484,826 | B1 | 11/2002 | Anderson | |
| 6,510,906 | B1 | 1/2003 | Richert | |
| 6,513,606 | B1 | 2/2003 | Krueger | |
| 6,533,050 | B2 | 3/2003 | Molloy | |
| 6,594,881 | B2 | 7/2003 | Tibbitts | |
| 6,601,454 | B1 | 8/2003 | Botnan | |
| 6,622,803 | B2 | 9/2003 | Harvey | |
| 6,668,949 | B1 | 12/2003 | Rives | |
| 6,672,406 | B2 | 1/2004 | Beuershausen | |
| 6,729,420 | B2 | 5/2004 | Mensa-Wilmot | |
| 6,732,817 | B2 | 5/2004 | Dewey | |
| 6,822,579 | B2 | 11/2004 | Goswami | |
| 6,929,076 | B2 | 8/2005 | Fanuel | |
| 6,953,096 | B2 | 10/2005 | Gledhill | |
| 6,966,393 | B2 | 11/2005 | Brady | |
| 2001/0004946 | A1 * | 6/2001 | Jensen | 175/428 |
| 2003/0213621 | A1 | 11/2003 | Britten | |
| 2004/0026983 | A1 * | 2/2004 | McAlvain | 299/111 |
| 2004/0238221 | A1 | 12/2004 | Runia | |
| 2004/0256155 | A1 | 12/2004 | Kriesels | |

* cited by examiner

ROOF MINING DRILL BIT

CROSS REFERENCE TO RELATED APPLICATION

This application is a continuation of U.S. patent application Ser. No. 11/774,667 Jul. 9, 2007 now abandoned. U.S. patent application Ser. No. 11/774,667 is also a continuation-in-part of U.S. patent application Ser. No. 11/766,975 Jun. 22, 2007 now U.S. Pat. No. 8,122,980. U.S. patent application Ser. No. 11/774,667 is also a continuation-in-part of U.S. patent application Ser. No. 11/774,227 Jul. 6, 2007 now U.S. Pat. No. 7,669,938 which is a continuation-in-part of U.S. patent application Ser. No. 11/773,271 Jul. 3, 2007 now U.S. Pat. No. 7,997,661 which is a continuation-in-part of U.S. patent application Ser. No. 11/766,903 Jun. 22, 2007 which is a continuation of U.S. patent application Ser. No. 11/766,865 Jun. 22, 2007 now abandoned which is a continuation-in-part of U.S. patent application Ser. No. 11/742,304 Apr. 30, 2007 now U.S. Pat. No. 7,475,948 which is a continuation of U.S. patent application Ser. No. 11/742,261 Apr. 30, 2007 now U.S. Pat. No. 7,469,971 which is a continuation-in-part of U.S. patent application Ser. No. 11/464,008 Aug. 11, 2006 now U.S. Pat. No. 7,338,135 which is a continuation-in-part of U.S. patent application Ser. No. 11/463,998 Aug. 11, 2006 now U.S. Pat. No. 7,384,105 which is a continuation-in-part of U.S. patent application Ser. No. 11/463,990 Aug. 11, 2006 now U.S. Pat. No. 7,320,505 which is a continuation-in-part of U.S. patent application Ser. No. 11/463,975 Aug. 11, 2006 now U.S. Pat. No. 7,445,294 which is a continuation-in-part of U.S. patent application Ser. No. 11/463,962 Aug. 11, 2006 now U.S. Pat. No. 7,413,256 which is a continuation-in-part of U.S. patent application Ser. No. 11/463,953 Aug. 11, 2006 now U.S. Pat. No. 7,464,993. U.S. patent application Ser. No. 11/774,667 is also a continuation-in-part of U.S. patent application Ser. No. 11/695,672 Apr. 3, 2007 now U.S. Pat. No. 7,396,086 which is a continuation-in-part of U.S. patent application Ser. No. 11/686,831 Mar. 15, 2007 now U.S. Pat. No. 7,568,770. All of these applications are herein incorporated by reference for all that they contain.

BACKGROUND OF THE INVENTION

This invention relates to drill bits, more specifically to improvements in roof drill bits for drilling and boring in roof bolting operations for mining.

Such cutting elements are often subjected to intense forces, torques, vibration, high temperatures and temperature differentials during operation. As a result, stresses within the bit may begin to form. Drag bits for example may exhibit stresses aggravated by drilling anomalies during roof boring operations such as bit whirl or bounce often resulting in spalling, delamination or fracture of the super hard abrasive layer or the substrate thereby reducing or eliminating the cutting elements efficacy and decreasing overall drill bit wear life. Damage typically found in drag bits may be a result of shear failures, although non-shear modes of failure are not uncommon.

Roof bolt bits have been disclosed in the patent prior art. U.S. Pat. No. 5,535,839 by Brady et al., which is herein incorporated by reference for all that it contains, discloses a roof bit that has two hard surfaced inserts having domed working surfaces.

U.S. Pat. No. D529,937 by Brady et al., which is herein incorporated by reference for all that it contains, discloses the design for a heavy duty roof drill bit.

U.S. Pat. No. 5,848,657 by Flood et al, which is herein incorporated by reference for all that it contains, discloses domed polycrystalline diamond cutting element wherein a hemispherical diamond layer is bonded to a tungsten carbide substrate, commonly referred to as a tungsten carbide stud. Broadly, the inventive cutting element includes a metal carbide stud having a proximal end adapted to be placed into a drill bit and a distal end portion. A layer of cutting polycrystalline abrasive material disposed over said distal end portion such that an annulus of metal carbide adjacent and above said drill bit is not covered by said abrasive material layer.

BRIEF SUMMARY OF THE INVENTION

In one aspect of the invention a rotary mine roof drilling apparatus has an arm attached to and intermediate a drill bit and a platform. The apparatus also has a thrusting mechanism adapted to push the drill bit into a mine roof or wall. The drill bit has a bit body intermediate a shank and a working surface. The working surface has a cutting element with a carbide substrate bonded to a diamond working end with a pointed geometry; and the diamond working end has a 0.050-0.200 inch apex radius.

In another aspect to the invention the working surface may have multiple cutting elements that aid in the drilling process. One cutting element may be substantially coaxial relative to the bit body and may aid in stabilizing the bit as it rotates. The substantially coaxial cutting element may also be spring loaded so as to counter any blunt forces. The substantially coaxial cutting element may also tilt relative to the bit body creating an angle between the axis of the bit body and the axis of the cutting element. The cutting element may be placed on other locations of working surface and be placed off-centered relative to the bit body.

In another aspect to the invention the working surface may comprise a cutting element that may be stationary as an outer cutting element may rotate around it. Multiple cutting elements may be placed on the bit body and may aid in the drilling process. The bit body is intermediate the working surface and a shank that has at least one connecting component that may attach to the arm. The arm attached to the shank may telescope to bring the drill bit in and out of contact with a formation.

The pointed geometry of 0.050-0.200 inch apex radius at the end of the diamond working end may also have a thickness of at least 0.100 inch, and may have infiltrated diamond. The diamond may also have a metal catalyst concentration of less than 5 percent by volume. The diamond may be processed in a high temperature high pressure press, and cleaned in a vacuum and sealed in a can by melting a sealant disk within the can prior to processing in the high temperature high pressure press. The diamond may also be bonded to a carbide substrate at an interface comprising a flat normal to the axis of the cutting element. The diamond may have a characteristic of being capable of withstanding greater than 80 joules in a drop test with carbide targets, and have a central axis that forms a 35-55 degree angle relative to a side of the diamond.

In some embodiments, the bits may be used for drilling and blasting.

DETAILED DESCRIPTION OF THE INVENTION AND THE PREFERRED EMBODIMENT

Figure 1:
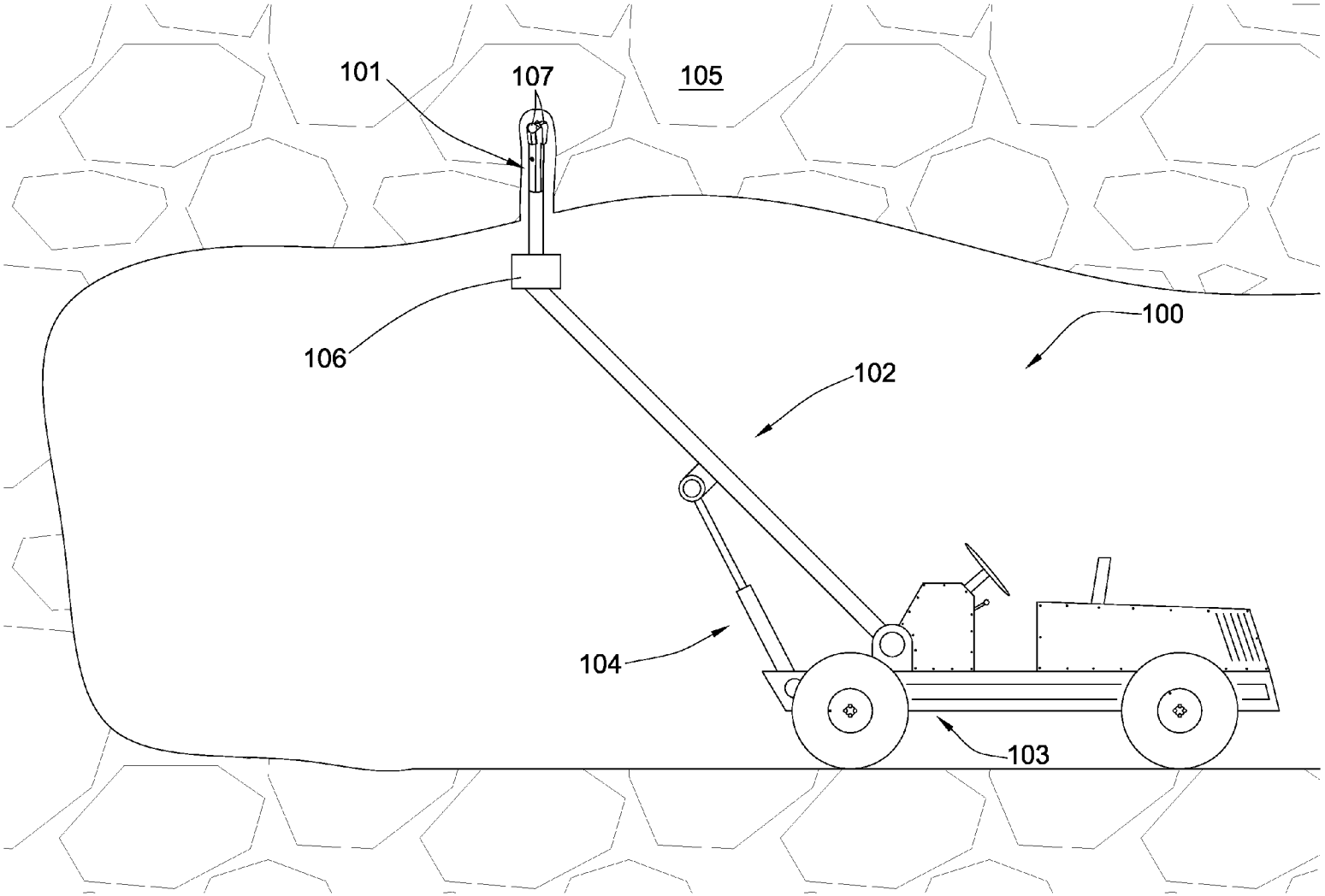
FIG. 1 is an orthogonal diagram of an embodiment of a roof mining machine attached to a drill bit.

FIG. 1 is an orthogonal diagram of a roof mining machine 100 attached to a roof mining drill bit 101. An arm 102 may be intermediate the drill bit 101 and a platform 103. The arm 102 may be attached to a hydraulic system 104 that may allow the arm 102 to move. The arm 102 may also be able to telescope to bring the drill bit 101 in and out of contact with the mine roof 105. A rotation device 106 may be attached to the arm 102 and be in communication with the drill bit 101. The drill bit 101 may rotate when the rotation device 106 is activated. The drill bit 101 may comprise multiple cutting elements 107 adapted to engage the roof of the mine 105 which may facilitate drilling.

Figure 2:
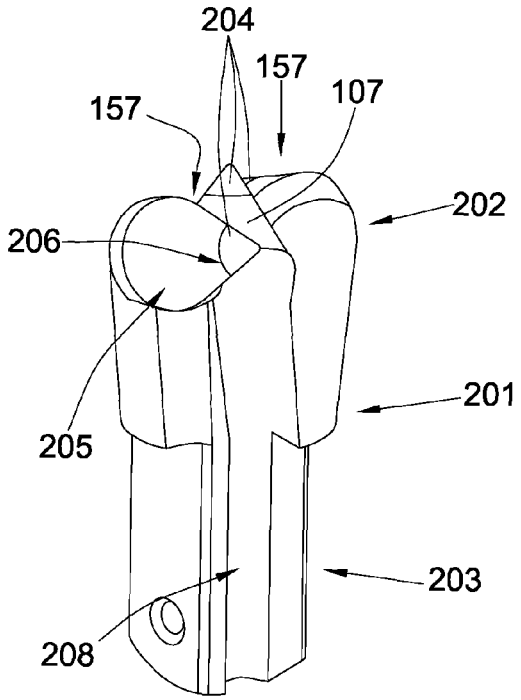
FIG. 2 is a perspective drawing of an embodiment of a roof mining drill bit.

FIG. 2 is a perspective diagram of a roof mining drill bit 101. The drill bit 101 may comprise a bit body 201 intermediate a working surface 202 and a shank 203. The working surface 202 may comprise multiple outer cutting elements 157 that comprise diamond working ends 204. Each diamond working end 204 may have a thickness of at least 0.100 to 0.500 inch with a pointed geometry comprising an apex radius of 0.050-0.200 inches. Generally, each diamond working end 204 is pointed in opposing directions relative to one another, as shown in FIG. 2. The diamond working end 204 may be bonded to a carbide substrate 205 at an interface 206 comprising a flat. The carbide substrate 205 may be brazed, press-fit, or a combination thereof to the working surface 202. A cutting element 107 may be placed substantially coaxial with the bit body 201 and may aid in stabilizing the drill bit 101 as outer cutting elements 157 rotate during the drilling process. As the drill bit 101 rotates a new layer of formation may be dislodged by a passing cutting element 157. At least one canal 208 may be present in the drill bit 101 to allow fluid to enter the bore hole and clear dislodged formations, cool the drill bit 101, soften the formation, or a combination thereof.

In some embodiments, the drill bit may be used to drill into a wall of the mine. The hole drilled may be filled with explosives which may then be ignited to open the hole.

Figure 2A:
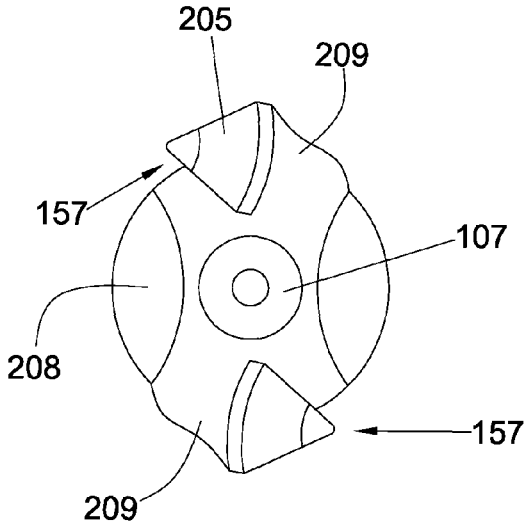
FIG. 2*a* is a top orthogonal diagram of a roof mining drill bit of the embodiment shown in FIG. 2.

FIG. 2*a* is a top orthogonal diagram of a roof mining drill bit 101. The base 209 of each outer cutting element 157 and the substantially coaxial cutting element 107 may be parallel to one another. The cutting element 107 that is substantially coaxial may also be slightly tilted in relation to the axis of the bit body. Canals 208 for fluid may be positioned on the sides of the drill bit 101.

Figure 3:
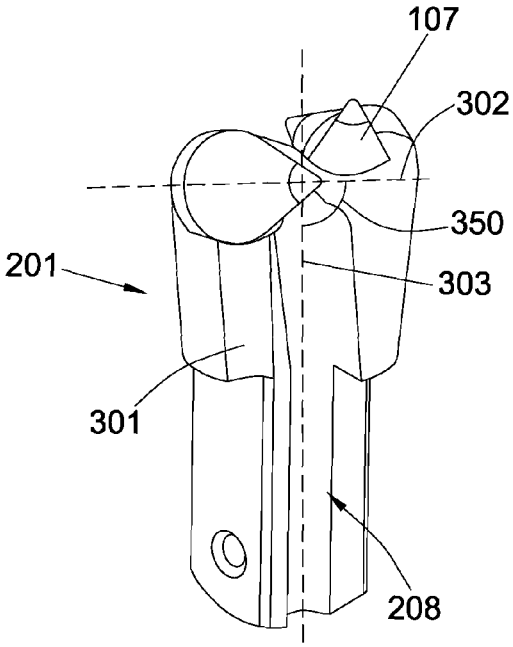
FIG. 3 is a perspective diagram of another embodiment of a roof mining drill bit.

FIG. 3 is a perspective diagram of a roof mining drill bit 101. A cutting element 107 may be off-centered relative to the bit body 201, as shown in FIG. 3. The shank 203 of the drill bit 101 may be adapted to attach to the arm 102 intermediate the drill bit 101 and a platform 103. The shank 203 may be made from steel, composites, carbide, matrix, or a combination thereof. Canals 208 for fluid to enter the formation may run along the axis of the drill bit 101. The outer cutting elements 157 may have an axis 302 forming an angle 350 of 90-180 degrees with the axis 303 of the bit body 201. The drill bit 101 may also comprise blades 301 that may aid in the removal of formation as the drill bit 101 rotates.

Figure 3A:
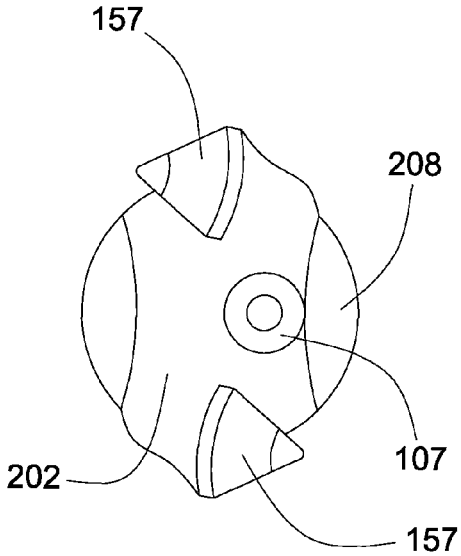
FIG. 3*a* is a top orthogonal diagram of a roof mining drill bit of the embodiment shown in FIG. 3.

FIG. 3*a* is a top orthogonal diagram of a roof mining drill bit 101. FIG. 3*a* shows a middle cutting element 107 off-centered and the outer cutting elements 157 parallel relative to one another. Canals 208 for fluid may be positioned on the sides of the drill bit 101. The off-centered cutting element 107 may be placed on either side of the working surface 202. The outer cutting elements 157 may also protrude slightly outward from the bit body 201.

Figure 4:
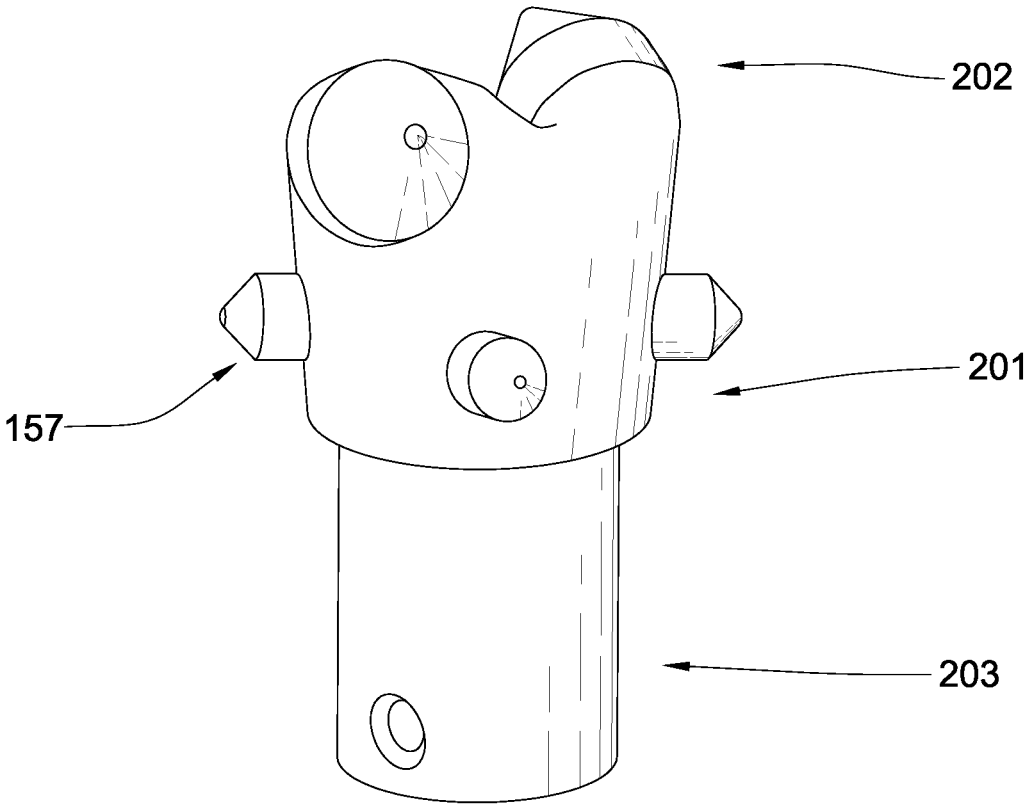
FIG. 4 is a perspective diagram of another embodiment of a roof mining drill bit.

FIG. 4 is a perspective diagram of another embodiment of a roof mining drill bit 101. Multiple outer cutting elements 157 may be placed on the shank 203 or on the bit body 201, as shown in FIG. 4. Placing multiple outer cutting elements 157 on the bit body 101 or shank 203 may help in the drilling process and spread force loads among cutting elements 157 improving the overall life of the bit. As the drill bit 101 rotates at least one outer cutting element 157 may be in contact with the formation which may improve the drilling process.

Figure 4A:
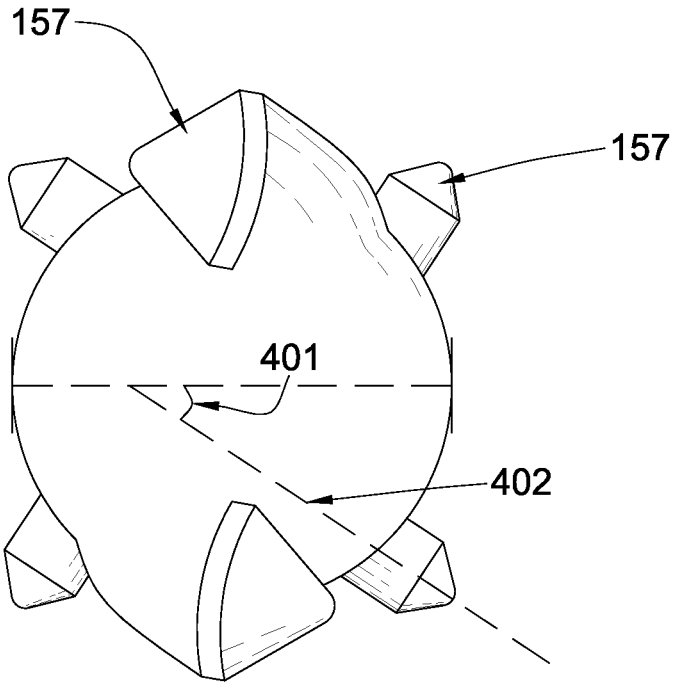
FIG. 4*a* is a top orthogonal diagram of a roof mining drill bit of the embodiment shown in FIG. 4.

FIG. 4*a* is a top orthogonal diagram of a roof mining drill bit 101. Multiple outer cutting elements 157 may protrude laterally from the drill bit 101. Multiple outer cutting elements 157 may also be on the working surface 202 of the drill bit 101. The axis 402 of the outer cutting element 157 on the bit body 201 relative to the diameter of the working surface 202 may comprise a negative, neutral, or positive rake angle 401.

Figure 5:
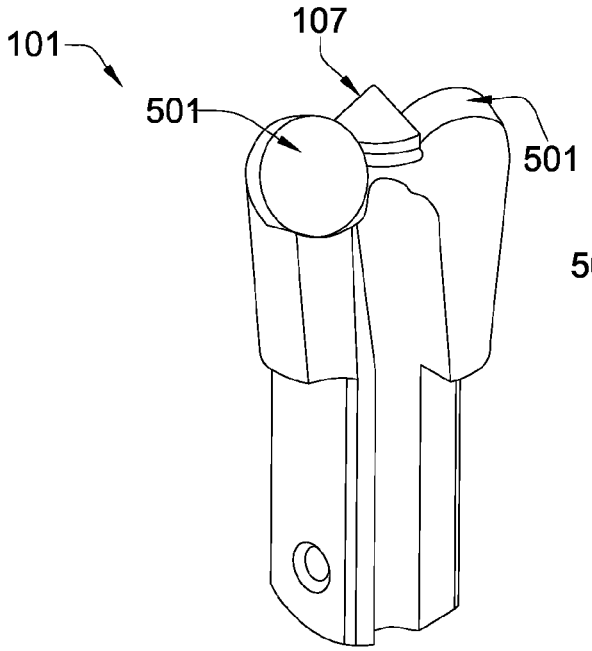
FIG. 5 is a perspective diagram of another embodiment of a roof mining drill bit.
Figure 5A:
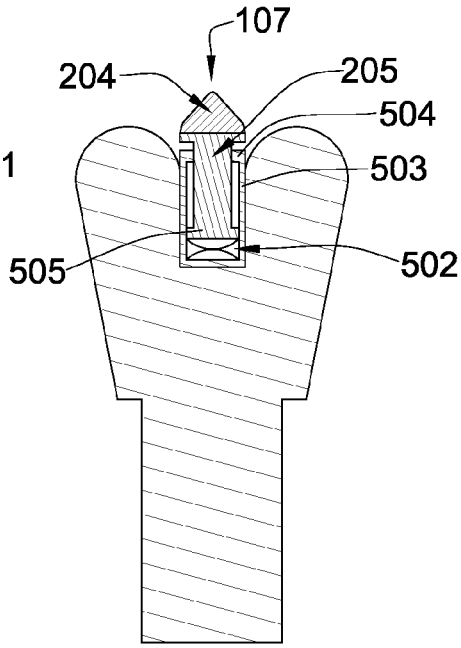
FIG. 5*a* is a cross-sectional of another embodiment of a roof mining drill bit.

FIG. 5 is a perspective diagram of a roof mining drill bit 101. In FIG. 5 a cutting element 107 is intermediate two flat cutting elements 501. The flat inserts may be made of diamond and aid in the drilling process. In FIG. 5*a* cutting element 107 is substantially coaxial and spring loaded. The cutting element 107 may comprise a housing 503 that comprises fingers 504. The housing 503 may comprise a spring mechanism 502. The spring mechanism 502 may be a coil spring, a compression spring, a tension spring, Belleville spring, wave spring, elastomeric material, gas spring, or combinations thereof. The springs, such as Belleville springs, may be stacked in alternating directions resulting in greater deflection. The spring mechanism 502 may also be stacked in the same direction creating a stiffer joint. Mixing and matching directions allow a specific spring constant and deflection capacity to be designed. The cutting element 107 may comprise a diamond working end 204 bonded to a carbide substrate 205. The carbide substrate 205 may comprise flanges 505 that may ensure that the carbide substrate 205 will not completely leave the housing 503.

Figure 6:
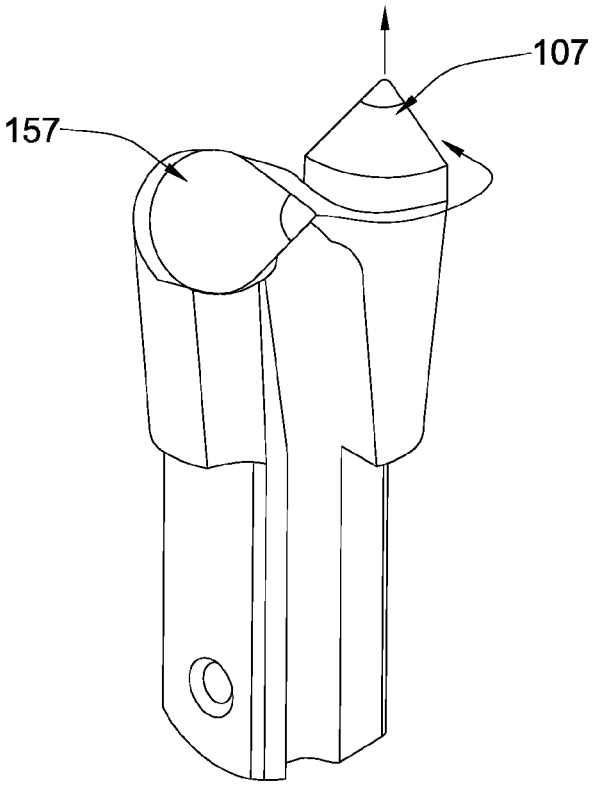
FIG. 6 is a perspective diagram of another embodiment of a roof mining drill bit.

FIG. 6 is a perspective diagram of another embodiment of a bi-center roof mining drill bit 101. A cutting element 107 may be adapted to engage the formation first and stabilize the drill bit 101. An outer cutting element 157 may rotate while degrading the formation.

Figure 7B:
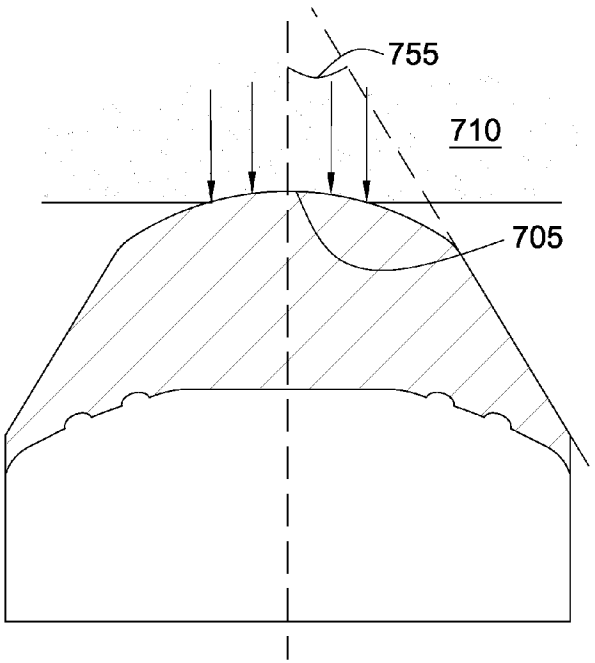
FIG. 7*b* is a cross-sectional diagram another embodiment of a diamond working end.
Figure 7A:
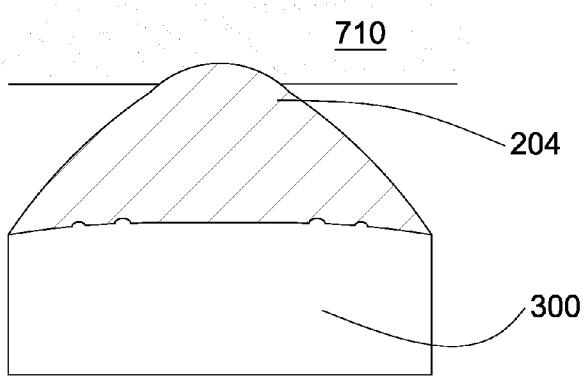
FIG. 7*a* is a cross-sectional diagram another embodiment of a diamond working end.
Figure 7:
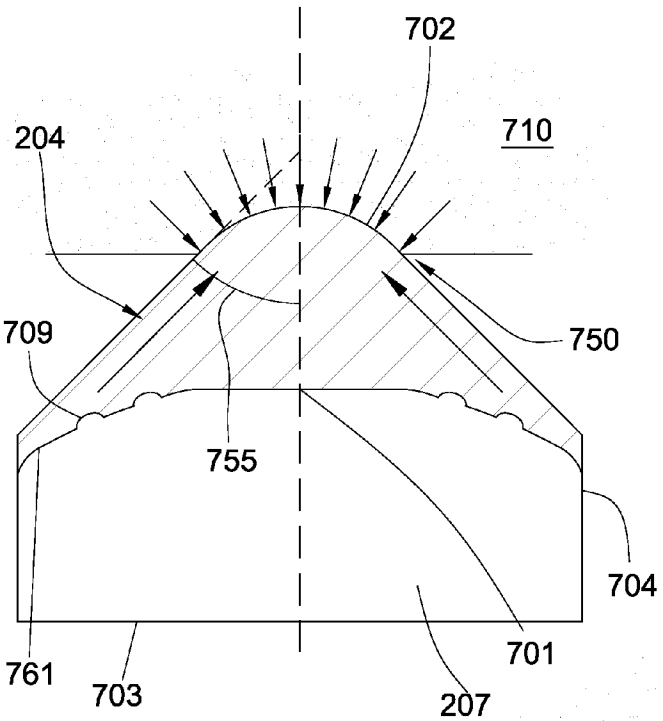
FIG. 7 is a cross-sectional diagram an embodiment of a diamond working end.

Now referring to FIG. 7 through 7*b* the substrate 207 comprises a tapered surface 761 starting from a cylindrical rim 704 of the substrate and ending at an elevated, flatted, central region 701 formed in the substrate 207. The diamond working end 204 comprises a substantially pointed geometry 700 with a sharp apex 702 comprising a radius of 0.050 to 0.200 inches. It is believed that the apex 702 is adapted to distribute impact forces across the flatted region 701, which may help prevent the diamond working end 204 from chipping or breaking The diamond working end 204 may comprise a thickness of 0.100 to 0.500 inches from the apex to the flatted region 701 or non-planar interface, preferably from 0.125 to 0.275 inches. The diamond working end 204 and the substrate 207 may comprise a total thickness of 0.200 to 0.700 inches from the apex 702 to a base 703 of the substrate 207. The sharp apex 702 may allow the high impact resistant tool to more easily cleave rock or other formations.

The pointed geometry 700 of the diamond working end 204 may comprise a side which forms a 35 to 55 degree angle with a central axis of the cutting element, though the angle 755 may preferably be substantially 45 degrees.

The pointed geometry 700 may also comprise a convex side or a concave side. The tapered surface of the substrate may incorporate nodules 709 at the interface between the diamond working end 204 and the substrate 207, which may provide more surface area on the substrate 207 to provide a stronger interface. The tapered surface 761 may also incorporate grooves, dimples, protrusions, reverse dimples, or combinations thereof. The tapered surface 761 may be convex, as in the current embodiment, though the tapered surface 761 may be concave.

Comparing FIGS. 7 and 7*b*, the advantages of having a pointed apex 702 as opposed to a blunt apex 705 may be seen. FIG. 7 is a representation of a pointed geometry 700 which was made by the inventors of the present invention, which has a 0.094 inch radius apex and a 0.150 inch thickness from the apex to the non-planar interface. FIG. 7*b* is a representation of another geometry also made by the same inventors comprising a 0.160 inch radius apex and 0.200 inch thickness from the apex to the non-planar geometry. The super hard geometries were compared to each other in a drop test performed at Novatek International, Inc. located in Provo, Utah. Using an Instron Dynatup 9250G drop test machine, the tools were secured to a base of the machine such that only the super hard geometry was exposed. The base of the machine was reinforced with a stronger foundation to reduce spring and improve the accuracy of the test. The target 710 comprising tungsten carbide 16% cobalt grade mounted in steel backed by a 19 kilogram weight was raised to the needed height required to generate the desired potential force, then dropped normally onto the super hard geometries. Each tool was tested at a starting 5 joules, if they passed they were retested with a new carbide target 710 and the force was increased by 10 joules per test until the tools failed. The pointed apex 702 of FIG. 7 surprisingly required about 5 times more joules to break than the thicker geometry of FIG. 7*b*.

It was shown that the sharper geometry of FIG. 7 penetrated deeper into the tungsten carbide target 710, thereby allowing more surface area of the diamond working end 204 to absorb the energy from the falling target by beneficially buttressing the penetrated portion of the super hard material 506 effectively converting bending and shear loading of the diamond substrate into a more beneficial quasi-hydrostatic type compressive forces drastically increasing the load carrying capabilities the diamond working end 204. On the other hand since the embodiment of FIG. 7*b* is blunter the apex hardly penetrated into the tungsten carbide target 710 thereby providing little buttress support to the diamond substrate and caused the diamond working end 204 to fail in shear/bending at a much lower load with larger surface area using the same grade of diamond and carbide. The average embodiment of FIG. 7 broke at about 130 joules while the average geometry of FIG. 7*b* broke at about 24 joules. It is believed that since the load was distributed across a greater surface area in the embodiment of FIG. 7 it was capable of withstanding a greater impact than that of the thicker embodiment of FIG. 7*b*.

Surprisingly, in the embodiment of FIG. 7, when the super hard geometry 700 finally broke, the crack initiation point 750 was below the radius. This is believed to result from the tungsten carbide target 710 pressurizing the flanks of the pointed geometry 700 (number not shown in the fig.) in the penetrated portion, which results in the greater hydrostatic stress loading in the pointed geometry 700. It is also believed that since the radius was still intact after the break, that the pointed geometry 700 will still be able to withstand high amounts of impact, thereby prolonging the useful life of the pointed geometry 700 even after chipping.

Figure 8D:
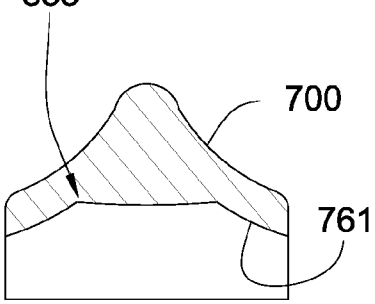
FIG. 8*d* is a cross-sectional diagram of another embodiment of a diamond working end.
Figure 8H:
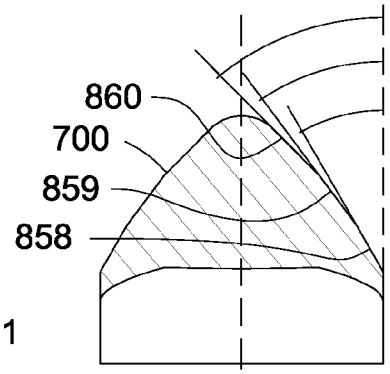
FIG. 8*h* is a cross-sectional diagram of another embodiment of a diamond working end.
Figure 8C:
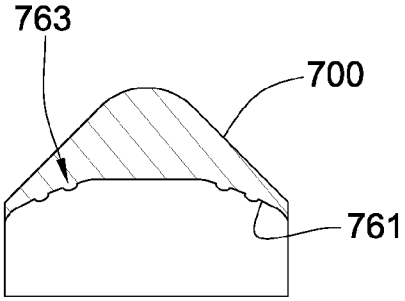
FIG. 8*c* is a cross-sectional diagram of another embodiment of a diamond working end.
Figure 8G:
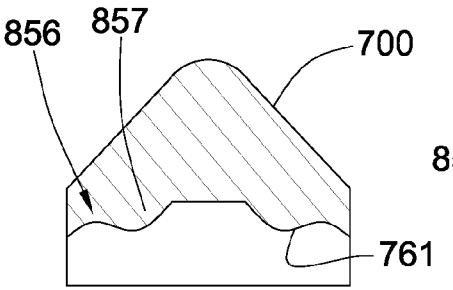
FIG. 8*a* is a cross-sectional diagram of another embodiment of a diamond working end.
FIG. 8*b* is a cross-sectional diagram of another embodiment of a diamond working end.
FIG. 8*e* is a cross-sectional diagram of another embodiment of a diamond working end.
FIG. 8*f* is a cross-sectional diagram of another embodiment of a diamond working end.
Figure 8B:
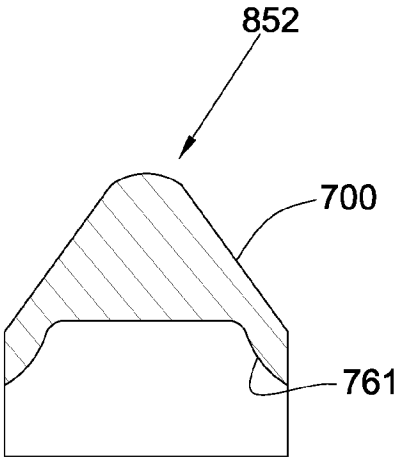
Figure 8F:
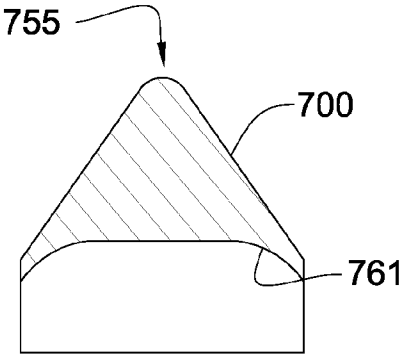
Figure 8A:
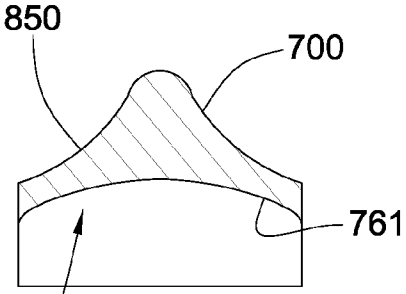
Figure 8E:
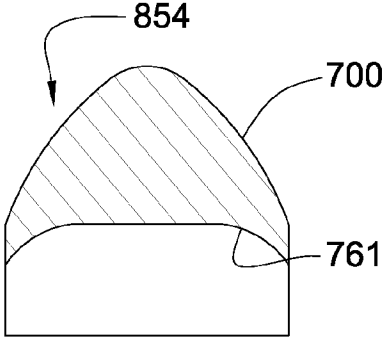

FIGS. 8*a* through 8*g* disclose various possible embodiments comprising different combinations of tapered surface 761 and pointed geometries 700. FIG. 8*a* illustrates the pointed geometry 700 with a concave side 850 and a continuous convex substrate geometry 851 at the interface 761. FIG. 8*b* comprises an embodiment of a thicker super hard material 852 from the apex to the non-planar interface, while still maintaining this radius of 0.075 to 0.125 inches at the apex. FIG. 8*c* illustrates grooves 863 formed in the substrate to increase the strength of interface. FIG. 8*d* illustrates a slightly concave geometry at the interface 853 with concave sides. FIG. 8*e* discloses slightly convex sides 854 of the pointed geometry 700 while still maintaining the 0.075 to 0.125 inch radius. FIG. 8*f* discloses a flat sided pointed geometry 855. FIG. 8*g* discloses concave and convex portions 857, 856 of the substrate with a generally flatted central portion.

Now referring to FIG. 8*h*, the diamond working end 204 (number not shown in the fig.) may comprise a convex surface comprising different general angles at a lower portion 858, a middle portion 859, and an upper portion 860 with respect to the central axis of the tool. The lower portion 858 of the side surface may be angled at substantially 25 to 33 degrees from the central axis, the middle portion 859, which may make up a majority of the convex surface, may be angled at substantially 33 to 40 degrees from the central axis, and the upper portion 860 of the side surface may be angled at about 40 to 50 degrees from the central axis.

Figure 9:
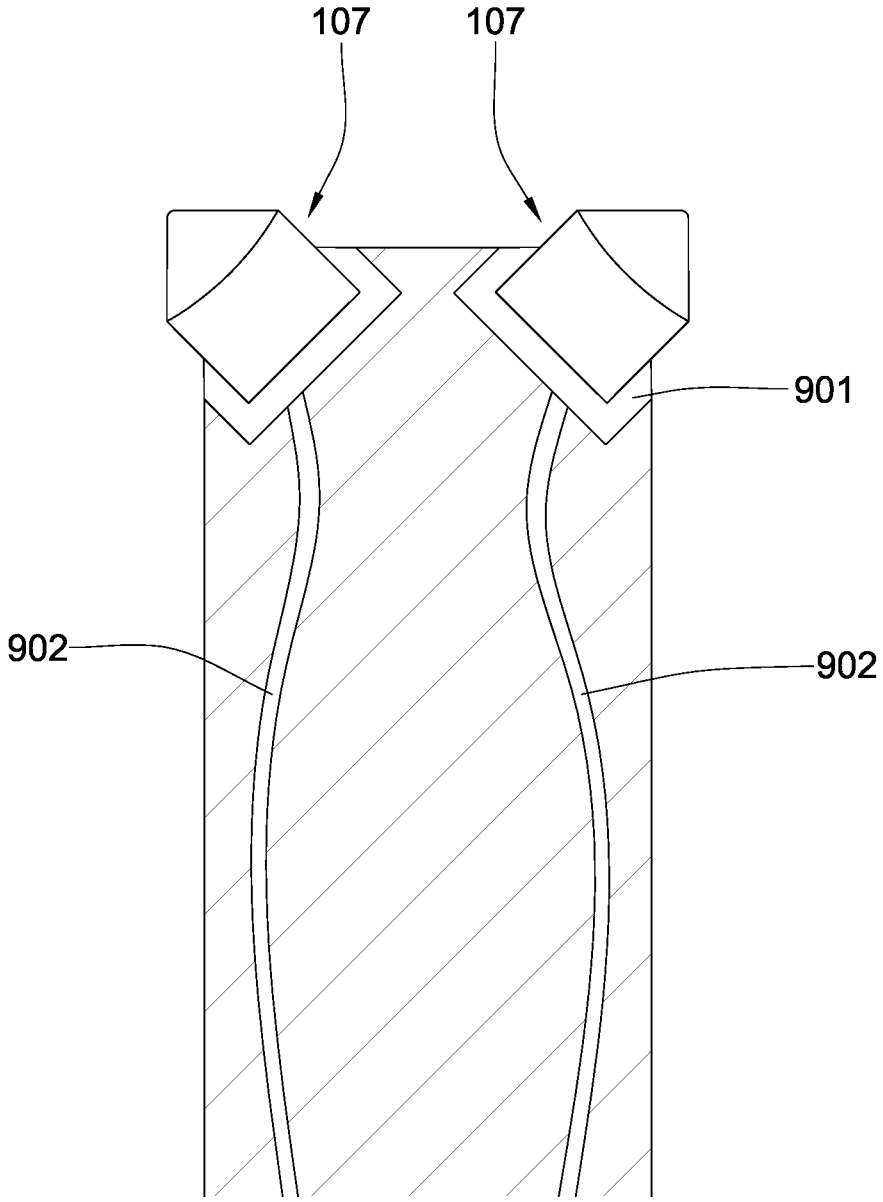
FIG. 9 is a cross-sectional diagram of another embodiment of a roof mining drill bit.

FIG. 9 is a cross-sectional diagram a roof mining drill bit. FIG. 9 shows cutting elements 107 that are electrically isolated. The cutting element 107 may be placed within a dielectric material 901. The dielectric material 901 may be a ceramic, a rubber, a plastic, a metal, a gas or combinations thereof. Wires 902 may run through the dielectric material 901 and be in communication with a power source. It is believed that by electrically isolating the cutting elements 107 signals may be sent into the formation to gather data. Electrically isolated cutting elements may have the advantage of being capable of picking up electrically signals from the formation, such as a laterolog resistivity signal sent from another source. In some embodiments, current may be passed through the electrically isolated cutting elements and may be the laterolog resistivity source. In other embodiments, a transducer, such as a magnetostrictive or piezoelectric transducer may be in communication with the cutting elements which may be used to determine formation characteristics while drilling. Such measurements may help miners identify potential minerals pay zones in the mines while drilling holes for the roof bolts.

Figure 10:
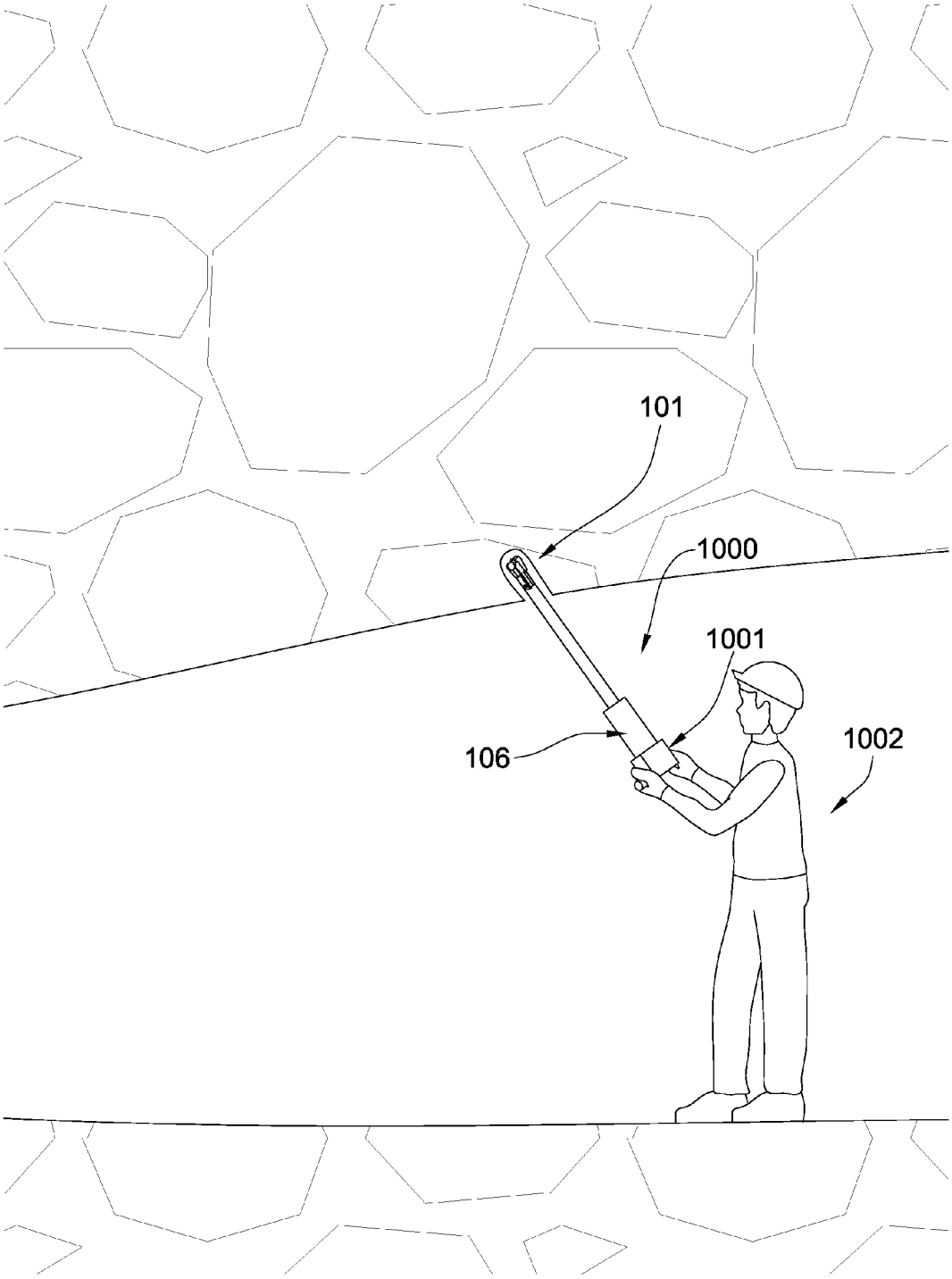
FIG. 10 is a perspective diagram of an embodiment of a handheld rotary mine roof drilling apparatus.

FIG. 10 is a perspective diagram of a handheld rotary roof mining machine 1000 attached to a drill bit 101. FIG. 10 shows a person 1002 drilling a hole into the roof of a mine. The roof mining machine 1000 may comprise a driving mechanism 1001 and a rotation device 106 that rotates the drill bit 101. This may be advantageous in mines that are relatively small and unable to accommodate larger machines.

Whereas the present invention has been described in particular relation to the drawings attached hereto, it should be understood that other and further modifications apart from those shown or suggested herein, may be made within the scope and spirit of the present invention.

What is claimed is:

1. A rotary drilling apparatus, comprising;

the drill bit comprising a bit body intermediate a shank and a working surface;

the working surface comprising outer cutting elements with a carbide substrate bonded to a diamond working end with a pointed geometry, and the diamond working end comprising a 0.075 to 0.110 inch apex radius;

the outer cutting elements are pointed in opposing directions relative to another;

the outer cutting elements have an axis that forms an angle of 90 to 180 degrees with the axis of the bit body;

a central cutting element is positioned intermediate the opposing outer cutting elements and substantially coaxial with the bit body, the central cutting element also comprises the diamond working end comprising a 0.075 to 0.110 inch apex radius;

the central cutting element is configured to stabilize the drill bit as the outer cutting elements rotate about the central axis of the bit body;

wherein at an interface between the diamond and carbide substrate, the substrate comprises a tapered surface starting from a cylindrical rim of the substrate and ending at an elevated central region formed in the substrate.

2. The apparatus of claim 1, wherein the central cutting element is slightly tilted in relation to the central axis of the bit body.

3. The apparatus of claim 1, wherein the at least one of the cutting elements is placed within a dielectric material.

4. The apparatus of claim 3, wherein a wire runs from the cutting element, through the dielectric material, and is in communication with a power source.

5. The apparatus of claim 1, wherein metal in the diamond material of at least one cutting element causes the diamond to be electrically conductive enough to pick up a laterolog resistivity signal and the at least one cutting element is electrically isolated from the bit body.

6. The apparatus of claim 1, wherein a canal is formed in the drill bit that runs along the central axis of the bit body and is configured to direct fluid into a formation.

7. The apparatus of claim 1, wherein the axis of at least one outer cutting element is substantially parallel with another and another axis of another outer cutting element.

8. The apparatus of claim 1, wherein at least one of the central cutting element and the outer cutting elements comprise slightly convex sides.

9. The apparatus of claim 1, wherein at least one of the central cutting element and the outer cutting elements comprise a side formed by portions of different angles.

10. The apparatus of claim 9, wherein the at least one of the portions is an upper portion that forms a 40 to 50 degree angle with the central axis.

11. The apparatus of claim 9, wherein the at least one of the portions is an middle portion that forms a 33 to 40 degree angle with the central axis.

12. The apparatus of claim 9, wherein the at least one of the portions is an lower portion that forms a 25 to 33 degree angle with the central axis.

* * * * *